US011154968B2

(12) United States Patent
Moran et al.

(10) Patent No.: US 11,154,968 B2
(45) Date of Patent: Oct. 26, 2021

(54) OIL FILTER REMOVAL DEVICE

(71) Applicants: Kevin Francis Moran, South Lyon, MI (US); Elliott Heinrich, Grand Rapids, MI (US)

(72) Inventors: Kevin Francis Moran, South Lyon, MI (US); Elliott Heinrich, Grand Rapids, MI (US)

( * ) Notice: Subject to any disclaimer, the term of this patent is extended or adjusted under 35 U.S.C. 154(b) by 167 days.

(21) Appl. No.: 16/599,874

(22) Filed: Oct. 11, 2019

(65) Prior Publication Data

US 2021/0107123 A1 Apr. 15, 2021

(51) Int. Cl.
*B25B 27/00* (2006.01)
*B25B 13/50* (2006.01)

(52) U.S. Cl.
CPC ..... *B25B 27/0042* (2013.01); *B25B 13/5008* (2013.01)

(58) Field of Classification Search
CPC ..... B25B 27/0042; B25B 13/5008; B01D 2201/24
USPC ..... 81/176.2; 7/100
See application file for complete search history.

(56) References Cited

U.S. PATENT DOCUMENTS 710,787 A 10/1902 Lewis
2,374,613 A 4/1945 Muller
2,746,330 A 5/1956 Pfeizing
3,385,141 A 5/1968 Norman
3,604,290 A 9/1971 Waite et al.
4,001,904 A 1/1977 Gill
4,266,452 A 5/1981 Crist
4,267,945 A * 5/1981 Maynard, Jr. ..... B67C 11/02 141/327
4,376,703 A * 3/1983 Krauss ..... B01D 35/31 184/1.5
4,402,287 A 9/1983 Cochran
4,714,138 A * 12/1987 Zaccone ..... B25B 27/0042 137/320
4,766,781 A 8/1988 Grise et al.
4,867,017 A 9/1989 Holman
5,199,331 A * 4/1993 Tsukamoto ..... B25B 13/48 81/121.1

(Continued)

OTHER PUBLICATIONS

Leaton Silicone Collapsible Funnel Foldable Funnel for Liquid Transfer 100% Food Grade Silicone (Green), available at URL https://www.amazon.com/Leaton-Silicone-Collapsible-Foldable-Transfer/dp/B014DS29EE.

(Continued)

*Primary Examiner* — David B. Thomas
*Assistant Examiner* — Thomas Raymond Rodgers
(74) *Attorney, Agent, or Firm* — Burris Law, PLLC

(57) ABSTRACT

A device for removing an oil filter includes a sleeve. The sleeve includes a grip portion and a reservoir portion. The grip portion includes a wall and a plurality of spacer ribs. The wall is disposed about an axis and defines a filter cavity open through a first end of the grip portion to receive the oil filter therein. The spacer ribs extend radially inward from the wall and are configured to engage the filter. The reservoir portion extends from a second end of the grip portion and defines a reservoir cavity open to the filter cavity. The sleeve is movable between an extended position in which the reservoir portion is below the grip portion and a nested position in which the reservoir portion is at least partially nested within the grip portion.

19 Claims, 12 Drawing Sheets

(56) References Cited

U.S. PATENT DOCUMENTS

| | | | |
|---|---|---|---|
| 5,271,299 | A | 12/1993 | Wadsworth |
| 5,320,145 | A | 6/1994 | Avino |
| 5,353,666 | A | 10/1994 | Rogers |
| 5,366,400 | A | 11/1994 | Kucik |
| 5,845,552 | A | 12/1998 | Piascik |
| 5,924,342 | A | 7/1999 | Chou |
| 7,340,979 | B2 | 3/2008 | Sawyer |
| 7,849,968 | B1 | 12/2010 | Krepps |
| 2003/0062221 | A1 | 4/2003 | Burrow et al. |
| 2008/0276763 | A1 | 11/2008 | Greenberg |
| 2012/0198970 | A1 | 8/2012 | Robidoux |
| 2013/0161223 | A1 | 6/2013 | Tessier |

OTHER PUBLICATIONS

Kiwav Motors, Foldable oil funnel, available at URL https://www.kiwavmotors.com/en/tools-accessories/kiwav-motorcycle-silicone-foldable-collapsible-oil-funnel-detail.

* cited by examiner

OIL FILTER REMOVAL DEVICE

FIELD

The present disclosure relates to an oil filter removal device.

BACKGROUND

The statements in this section merely provide background information related to the present disclosure and may not constitute prior art.

Internal combustion engines typically require oil and oil filters to be changed periodically. In some applications, the oil filter can be located in a position where an amount of oil can be released from the oil filter and/or from the oil filter port during removal of the oil filter from the engine. It can be difficult to contain this released oil especially in applications where there is limited space for rigid tools and the operator's hands. Thus, the oil released while changing the oil filter typically is free to spill onto other parts of the engine, the parts of the apparatus (e.g., a vehicle, machinery, etc.) in which the engine is used, onto the person performing the oil change, or onto the ground. Additionally, oil and other fluids or substances generally present in the engine compartment environment (e.g., grease, dirt, fuel, water, etc.) can make the oil filter difficult to grip while attempting to unscrew it and can increase the chances of dropping the oil filter once removed. Dropping the oil filter can result in spilling residual oil within the oil filter.

Furthermore, oil changes typically require removing an oil plug to drain the oil into a catch basin. During the process of removing the plug, the plug can become slippery as it is coated in oil released from the oil reservoir. Thus, it can be easy to drop the plug into the catch basin, which can be messy, frustrating, and time consuming to recover.

The present disclosure addresses these and other issues associated with changing oil and removing oil filters.

SUMMARY

This section provides a general summary of the disclosure and is not a comprehensive disclosure of its full scope or all of its features.

In one form, a device for removing an oil filter includes a sleeve. The sleeve includes a grip portion and a reservoir portion. The grip portion includes a wall and a plurality of spacer ribs. The wall is disposed about an axis and defines a filter cavity open through a first end of the grip portion to receive the oil filter therein. The spacer ribs extend radially inward from the wall and are configured to engage the filter. The reservoir portion extends from a second end of the grip portion and defines a reservoir cavity open to the filter cavity. The sleeve is movable between an extended position in which the reservoir portion is below the grip portion and a nested position in which the reservoir portion is at least partially nested within the grip portion. According to a variety of alternate forms: the spacer ribs are angled such that a radial distance between the axis and the spacer ribs increases toward the first end of the grip portion; the wall is angled such that a radial distance between the axis and the wall increases toward the first end of the grip portion; the grip portion transitions to the reservoir portion at a first step and the spacer ribs extend into the first step to space the filter apart from the first step; the device further includes a retainer disposed within the sleeve and configured to resist removal of the filter from the grip portion; retainer includes a support body and a magnet, the support body supporting the magnet within the sleeve; the support body includes an outer ring, a hub, and a support structure extending radially between the outer ring and the hub to support the hub; the support structure includes a plurality of spokes; the sleeve includes a retainer rib that inhibits axial movement of the outer ring; the retainer rib extends circumferentially about the axis and defines a plurality of notches; the sleeve includes a lip portion extending from the first end of the grip portion and angling radially outward therefrom; the sleeve includes a plurality of lip support ribs extending radially inward from a wall of the lip portion; the reservoir portion includes a first region and a second region, the first region transitioning into the grip portion at a first step and transitioning into the second region at a second step; the reservoir portion includes a third region, the second region transitioning into the third region at a third step; at least one of the first step and the second step includes a groove that extends circumferentially about the axis; an end of the reservoir portion that is opposite the grip portion is closed to retain oil within the reservoir portion; an end of the reservoir portion that is opposite the grip portion is open to permit oil to drain from the reservoir portion; the entire sleeve is formed of a flexible material.

In another form, a device for removing an oil filter includes a flexible sleeve including a grip portion and a reservoir portion. The grip portion includes a wall and a plurality of spacer ribs. The wall is disposed about an axis and defines a filter cavity open through a first end of the grip portion to receive the oil filter therein. The spacer ribs extend radially inward from the wall and are configured to engage the filter. The reservoir portion extends from a second end of the grip portion and narrows toward an end of the sleeve that is opposite the grip portion. According to an alternate form: the device further includes a retainer including a support body and a magnet and the support body is coupled to the sleeve and supports the magnet within the sleeve.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
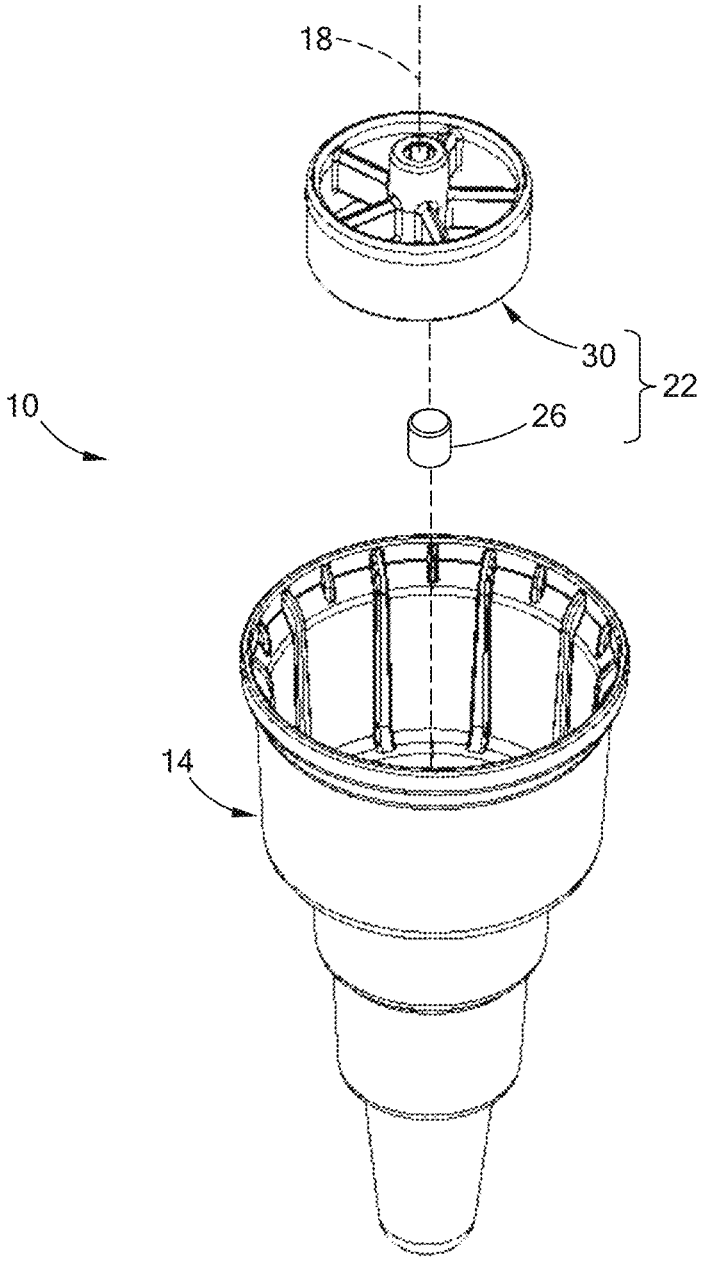
FIG. 1 is an exploded perspective view of an oil filter removal device in accordance with the teachings of the present disclosure, illustrating a sleeve and a retainer of the oil filter removal device.
Figure 2:
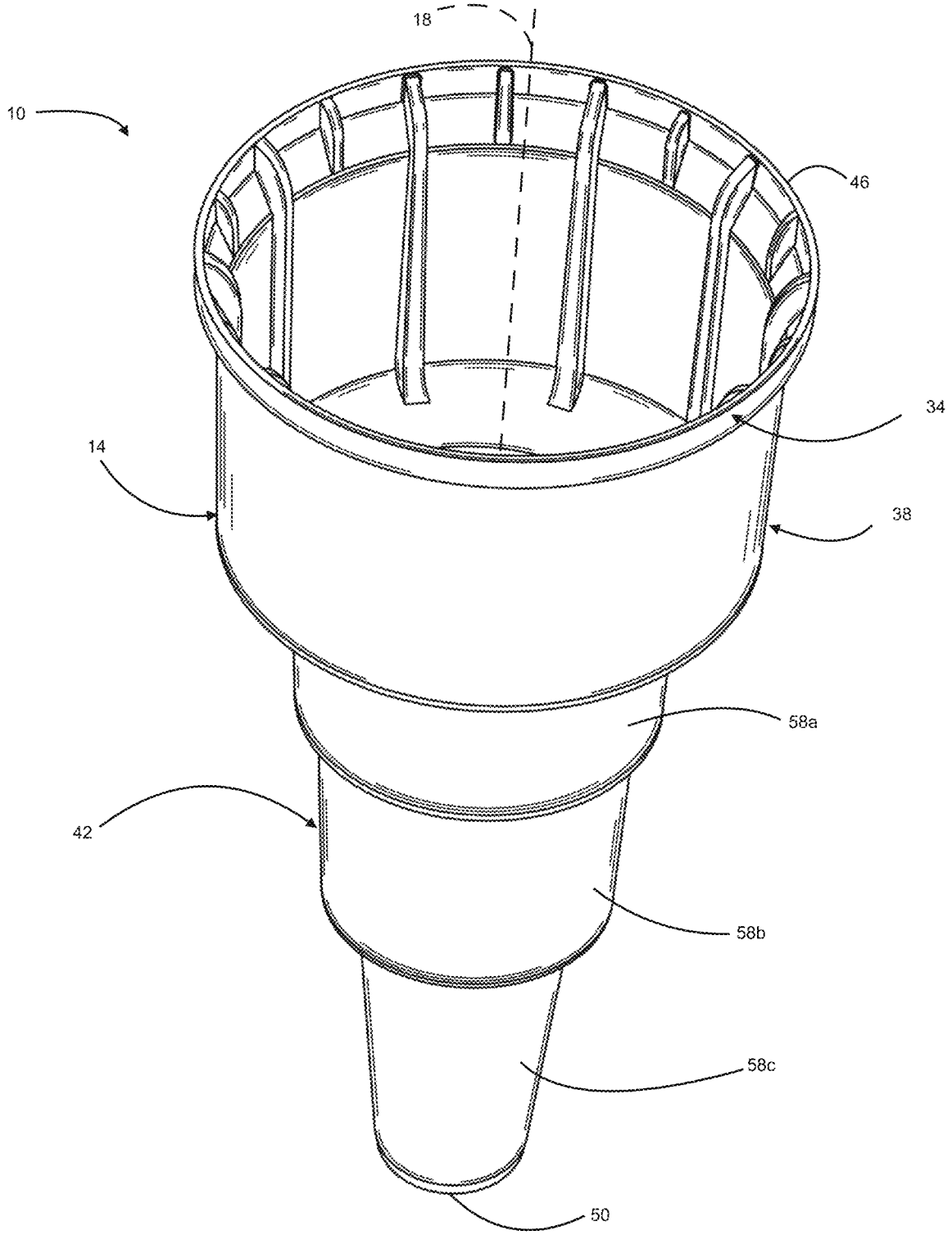
FIG. 2 is a top perspective view of the assembled oil filter removal device of FIG. 1.
Figure 3:
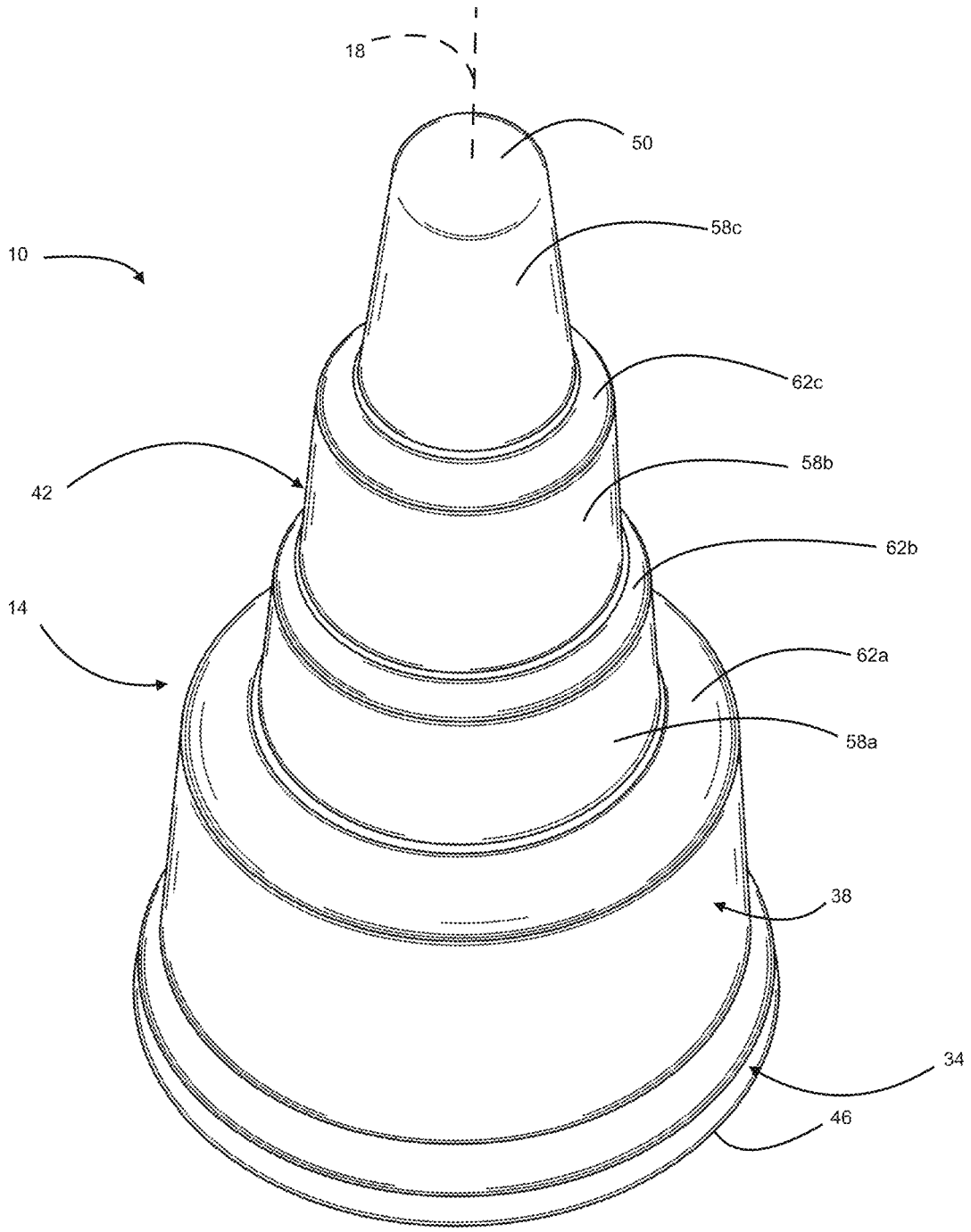
FIG. 3 is a bottom perspective view of the oil filter removal device of FIG. 2.
Figure 4:
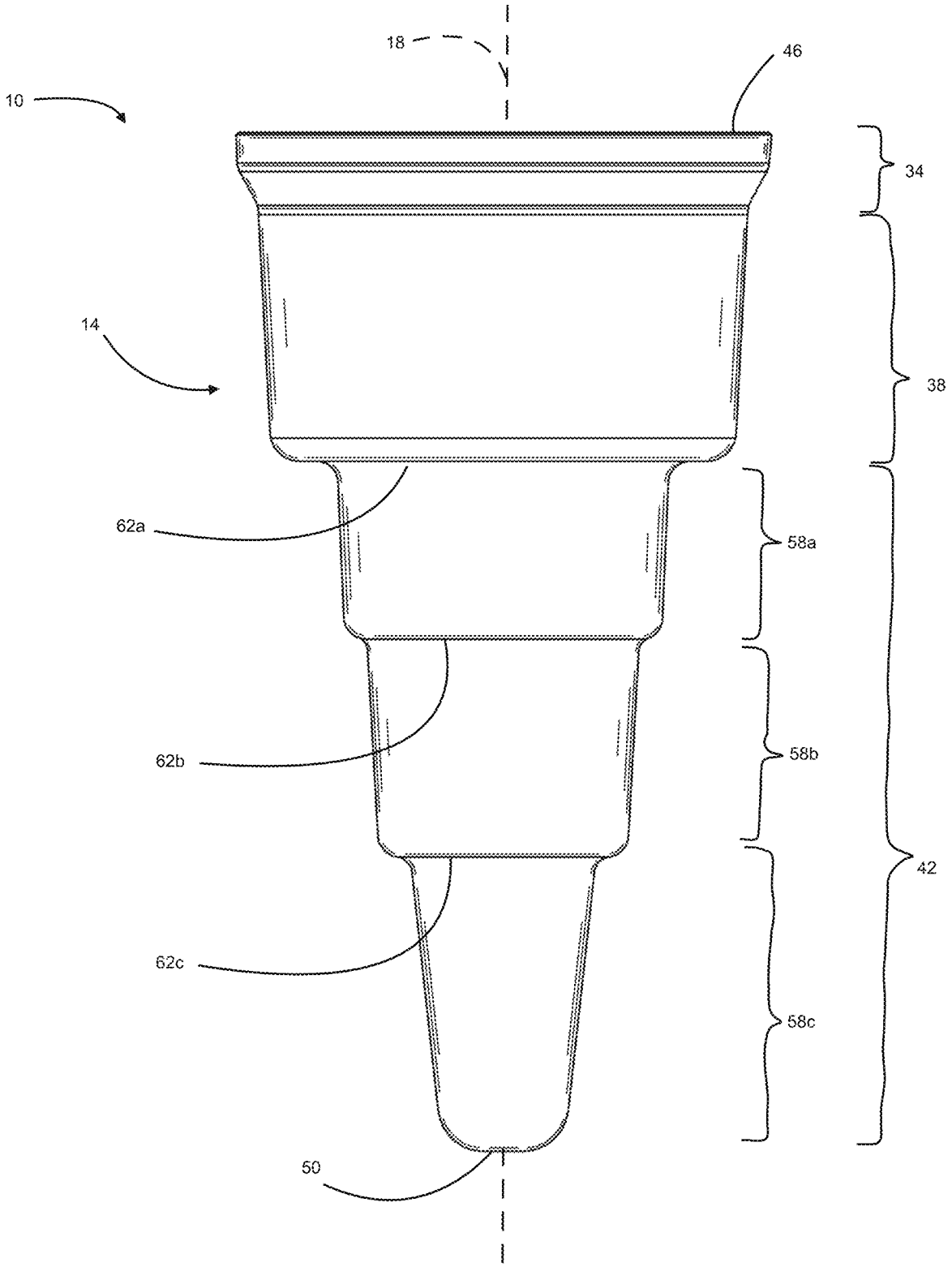
FIG. 4 is a side view of the of the oil filter removal device of FIG. 2.
Figure 5:
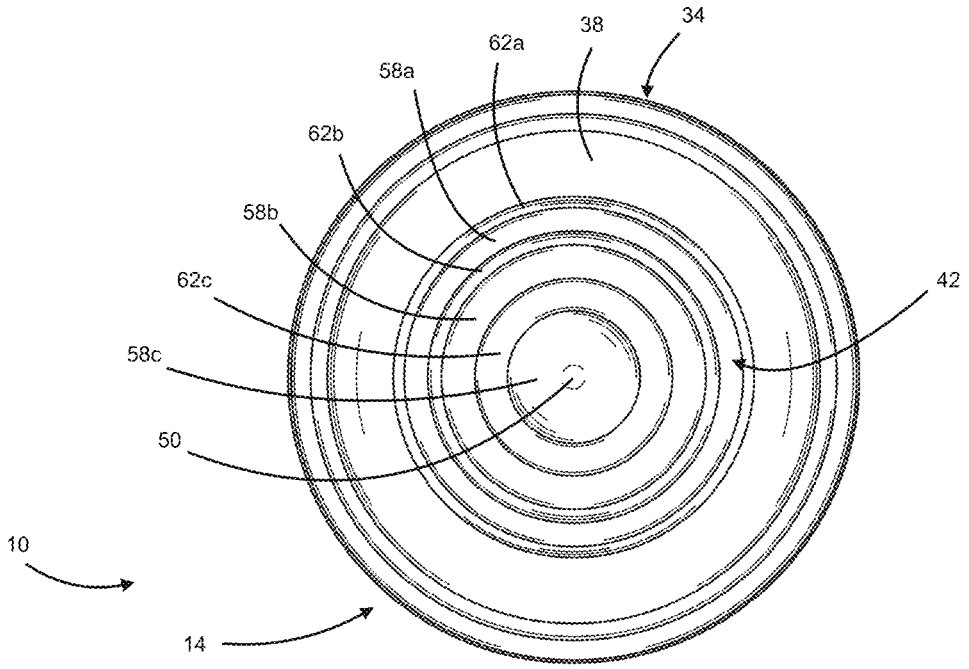
FIG. 5 is a bottom view of the oil filter removal device of FIG. 2.
Figure 6:
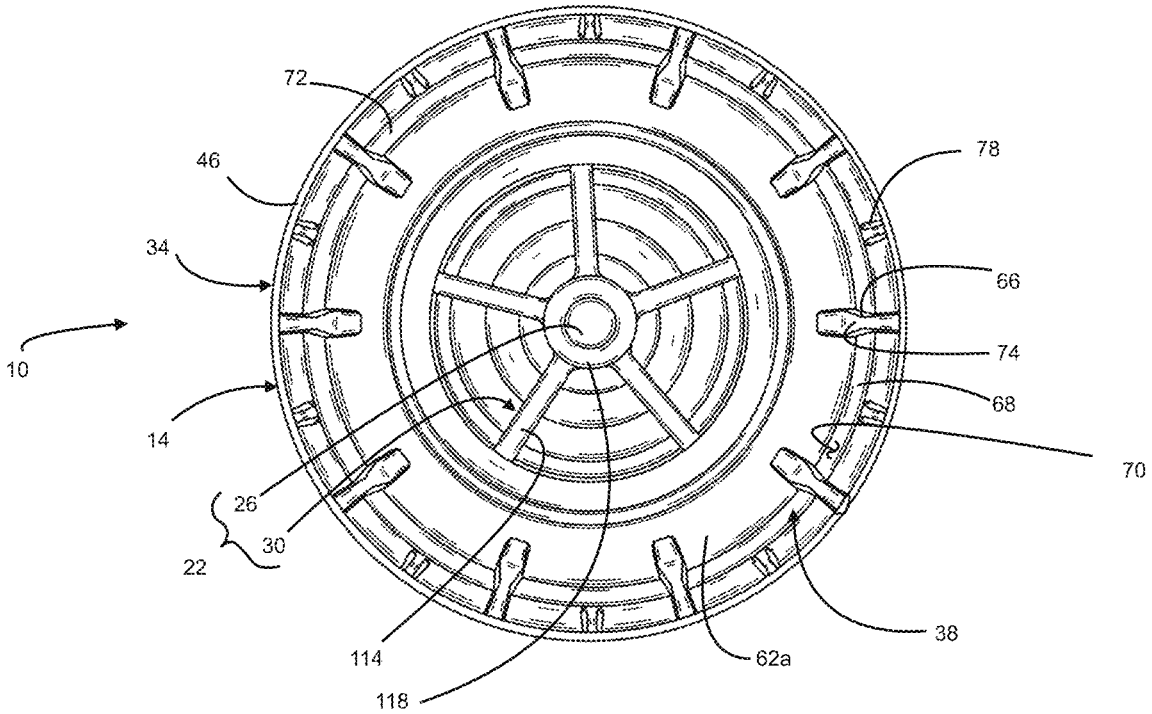
FIG. 6 is a top view of the oil filter removal device of FIG. 2.
Figure 7:
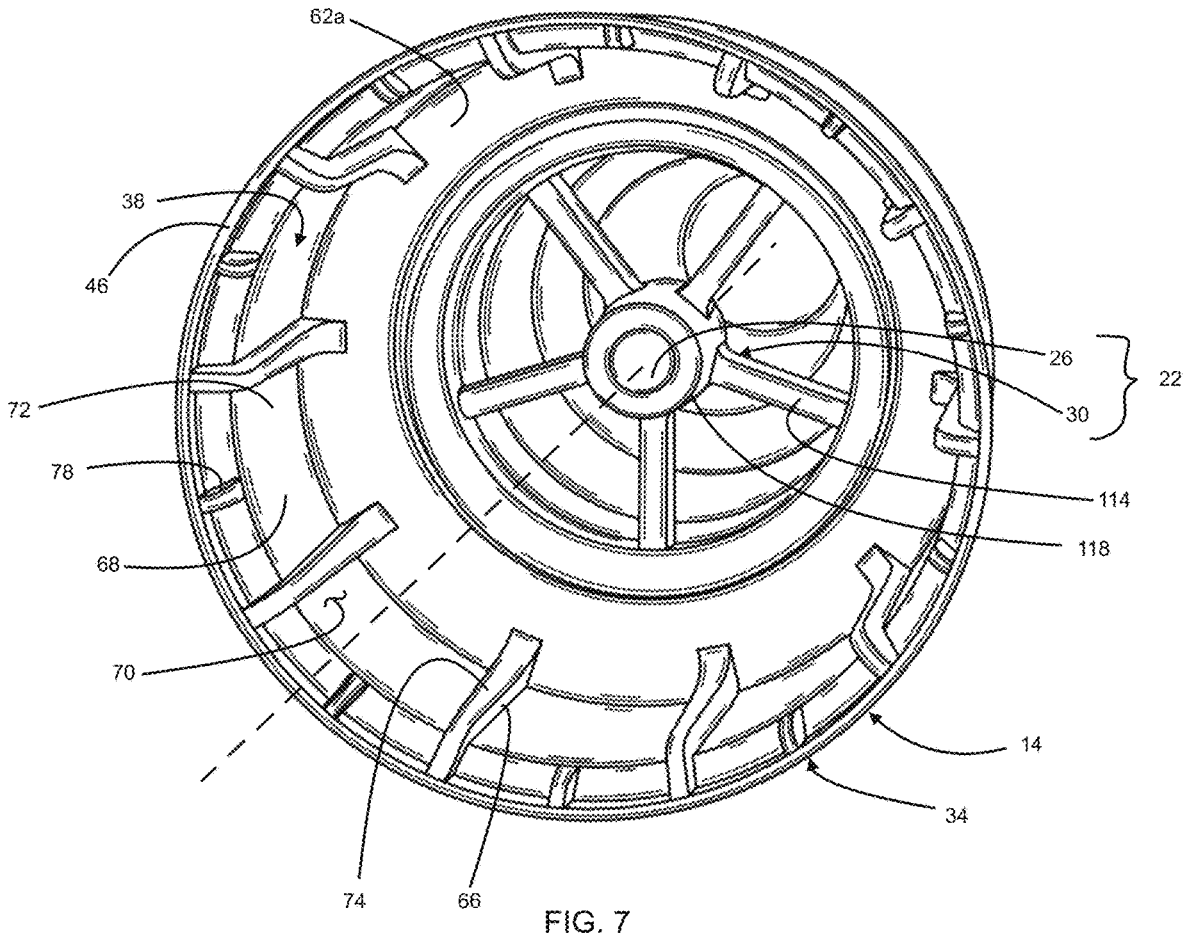
FIG. 7 is a different top perspective view of the oil filter removal device of FIG. 2.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features. Examples are provided to fully convey the scope of the disclosure to those who are skilled in the art. Numerous specific details are set forth such as types of specific components, devices, and methods, to provide a thorough understanding of variations of the present disclosure. It will be apparent to those skilled in the art that specific details need not be employed and that the examples provided herein, may include alternative embodiments and are not intended to limit the scope of the disclosure. In some examples, well-known processes, well-known device structures, and well-known technologies are not described in detail.

Referring to FIG. 1, an oil filter removal device 10 includes a sleeve 14 disposed about a central axis 18. In the example provided, the oil filter removal device 10 also includes a retainer 22. The retainer is described in greater detail below, but generally includes a magnet 26 and a support body 30 configured to support the magnet 26 within the sleeve 14. While illustrated and described herein with the retainer 22, the sleeve 14 may be used with or without the retainer 22.

The entire sleeve 14 is formed of a resilient and flexible oil resistant material that is stable over a large range of temperatures. The material can also be thermally insulating to inhibit transfer of heat from hot oil through the sleeve 14 to a user. In the example provided, the sleeve 14 is formed of flourosilicone (i.e., fluorinated silicone rubber), though other flexible oil resistant materials may be used. Another non-limiting example of an alternative material is EPDM rubber (i.e., ethylene propylene diene monomer rubber). As described in greater detail below, the sleeve 14 is formed as a unitarily formed body and is configured to flex in order to move between an extended position (shown in FIGS. 1-9) and a nested position (shown in FIGS. 10-13). In the example provided, the sleeve 14 is an opaque material. In another configuration, not specifically shown, the sleeve may be translucent in order to easily view a level of oil accumulating within the sleeve 14.

Referring to FIGS. 2-5 the sleeve 14 is includes a lip portion 34, a grip portion 38, and a reservoir portion 42 disposed about the central axis 18. The lip portion 34 defines a top end 46 of the sleeve 14, the reservoir portion 42 defines a bottom end 50 of the sleeve 14, and the grip portion 38 is disposed axially between the lip portion 34 and the reservoir portion 42. The top end 46 is open to receive an oil filter 54 (shown in FIGS. 8 and 9) therein. In the example provided, the bottom end 50 is closed to allow oil to be retained in the reservoir portion 42. In an alternative configuration, not shown, the bottom end 50 can define a drain aperture that can drip oil into a separate catch basin or can be attached to a drain hose to allow oil to drain to the separate catch basin.

In the example provided, the sleeve 14 has an overall generally tapered shape that narrows from the top end 46 to the bottom end 50. In the example provided, the lip portion 34 extends radially outward of the grip portion 38 and is generally tapered toward the grip portion 38. In the example provided, the reservoir portion 42 is defined by a series of regions including a first region 58*a*, a second region 58*b*, and a third region 58*c*. The sleeve 14 decreases in diameter at a first steps 62*a* from the grip portion 38 to the first region 58*a*, then decreases again at a second step 62*b* from the first region 58*a* to the second region 58*b*, then decreases again at a third step 62*c* from second region 58*b* to the third region 58*c*. The third region 58*c* defines the bottom end 50 of the sleeve 14. While three regions 58*a*, 58*b*, 58*c* are illustrated and described herein, more or fewer regions can be used.

Referring to FIGS. 6-9, the grip portion 38 includes a wall 68 disposed about the axis 18. The wall 68 has a radially inward facing surface 70 that generally defines a filter cavity 72 configured to receive the filter 54. A plurality of spacer ribs 66 protrude radially inward from the surface 70 and are spaced apart in the circumferential direction about the central axis 18. In the example provided, the spacer ribs 66 are equally spaced apart, though other configurations can be used. An inward facing surface 74 of the spacer ribs 66 faces radially inward and is configured to contact the filter 54 to space the surface 70 of the grip portion 38 apart from the filter 54. The spacer ribs 66 extend longitudinally in the axial direction within at least the grip portion 38. In the example provided, the spacer ribs 66 are angled along their length such that the radial distance from the central axis 18 to the surface 74 of the spacer ribs 66 is greater toward the top end 48. In the example provided, each spacer rib 66 extends longitudinally into the lip portion 34 to provide support for the lip portion 34 and help maintain the top end 46 open while guiding the filter 54 and oil into the grip portion 38. In the example provided, the other end of each spacer rib 66 transitions to also extend along a portion of the first step 62*a* such that the spacer ribs 66 maintain a gap between the end of the filter 54 and the first step 62*a*. In other words, the spacer ribs 66 can also inhibit the filter 54 from bottoming out and sealing on the first step 62*a*.

Figure 8:
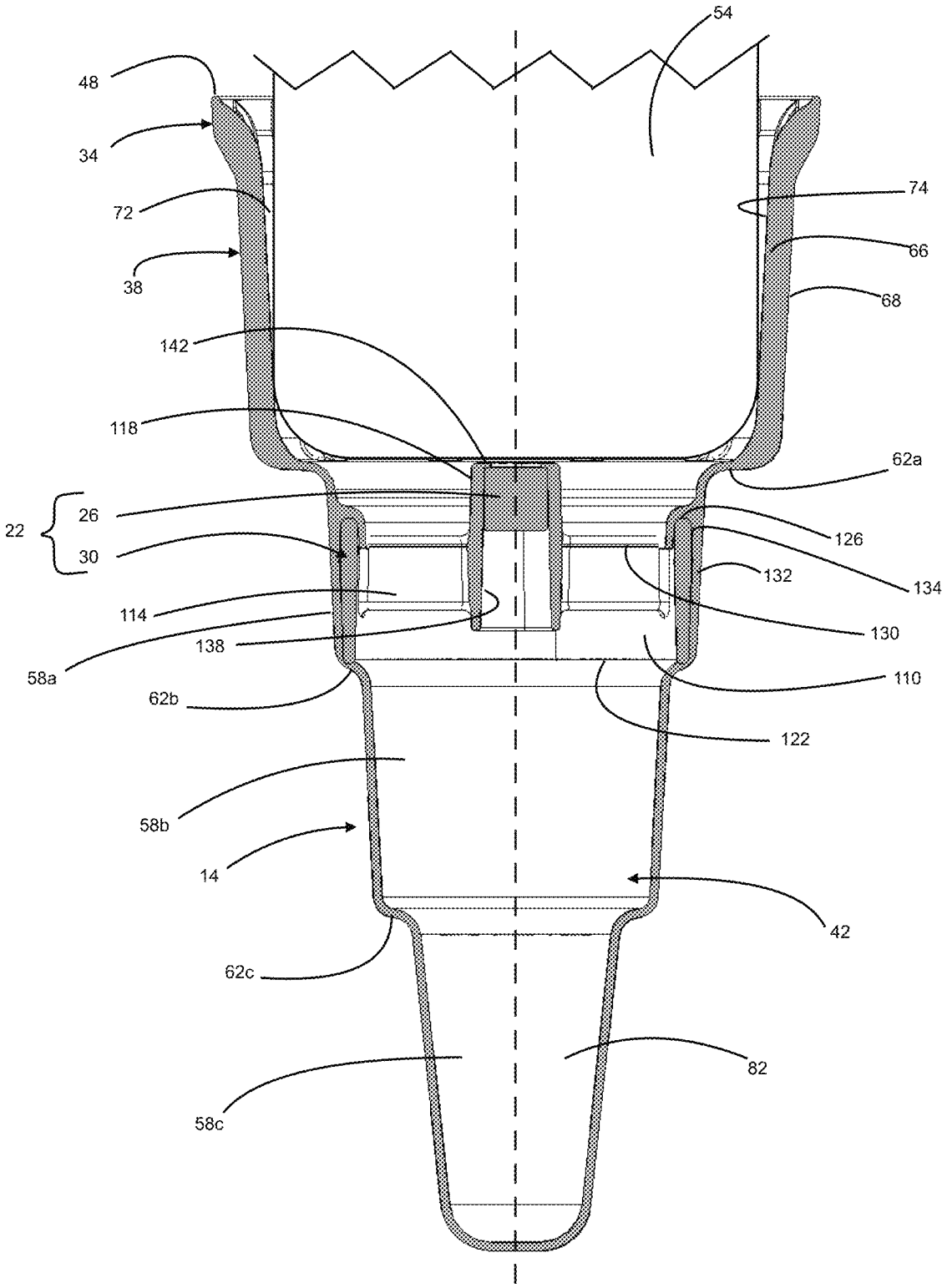
FIG. 8 is a cross-sectional view of the oil filter removal device of FIG. 2, taken along line 8-8 shown in FIG. 7.

The angle of the spacer ribs 66 can help guide the filter 54 into the position shown in FIG. 8 and can also permit filters of larger diameters to be gripped while still being spaced apart from the surface 70 of the grip portion 38. In the example provided, the angle of the spacer ribs 66 may correspond to the angle of the wall 68 or surface 70 of the grip portion 38, though other configurations can be used.

In the example provided, the sleeve 14 also includes additional support ribs 78 that protrude radially inward from the lip portion 34 and extend between the lip portion 34 and the grip portion 38 to provide additional structural support to the lip portion 34. The support ribs 78 and lip portion 34 are angled to help guide the filter 54 into the grip portion 38. In the example provided, the support ribs 78 are equally spaced about the central axis 18 and disposed circumferentially between adjacent spacer ribs 66, though other configurations can be used.

Figure 9:
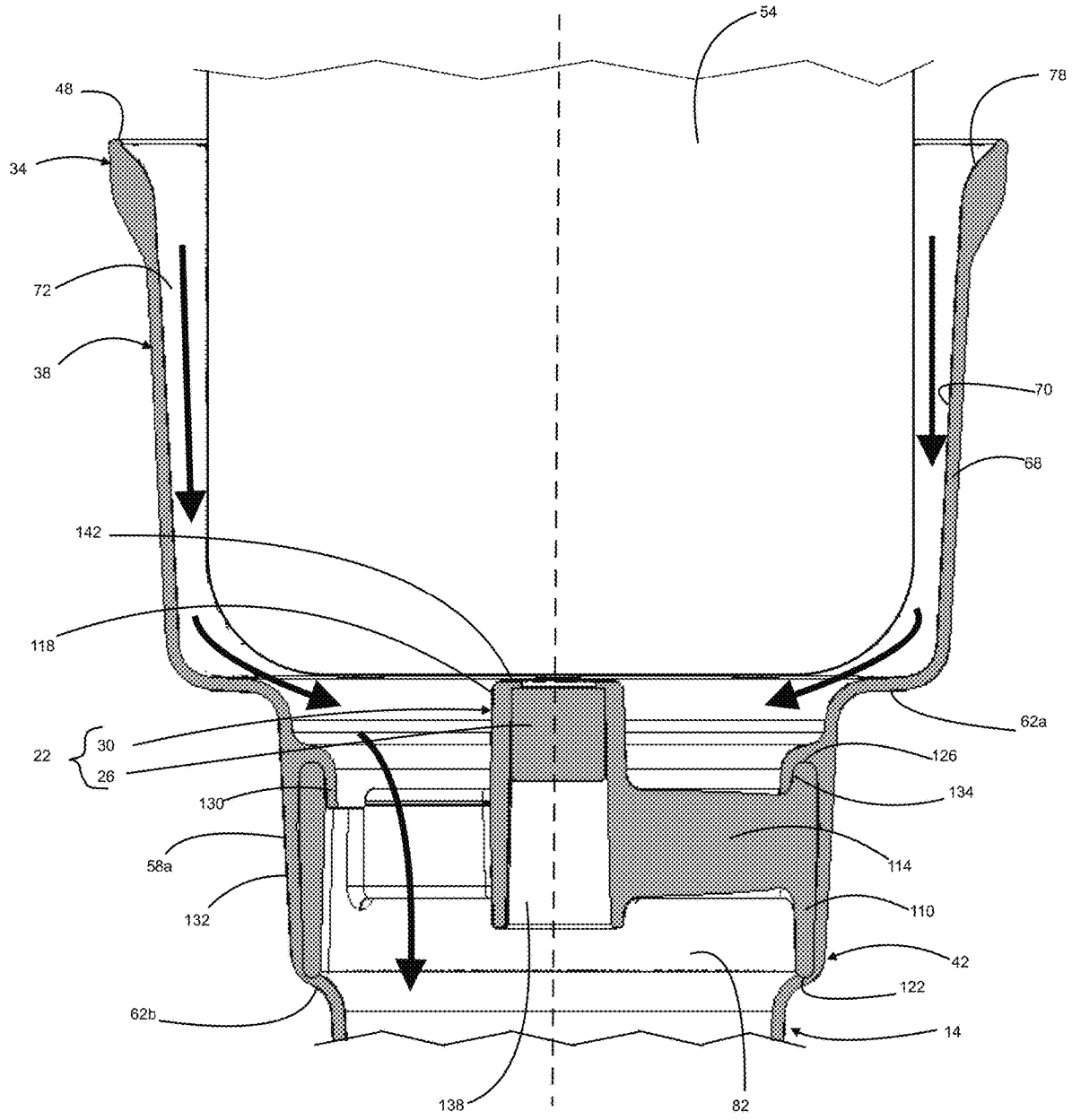
FIG. 9 is a cross-sectional view of the oil filter removal device of FIG. 2, taken along line 9-9 shown in FIG. 7.
Figure 10:
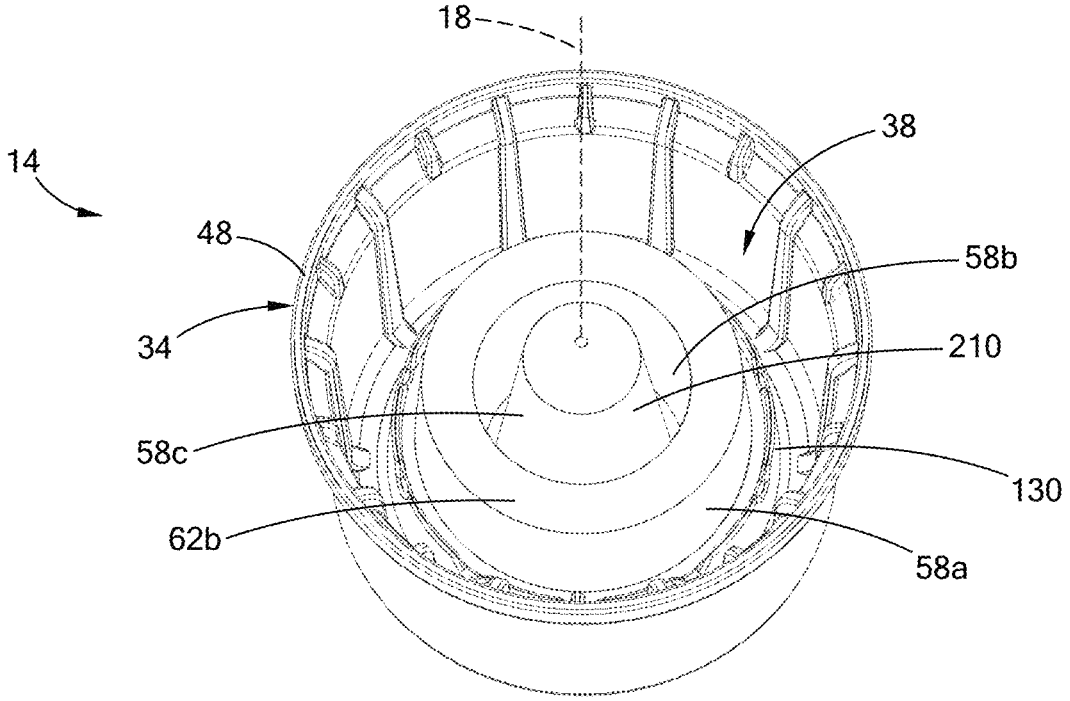
FIG. 10 is a top perspective view of the sleeve of FIG. 1 in a nested position in accordance with the teachings of the present disclosure.
Figure 11:
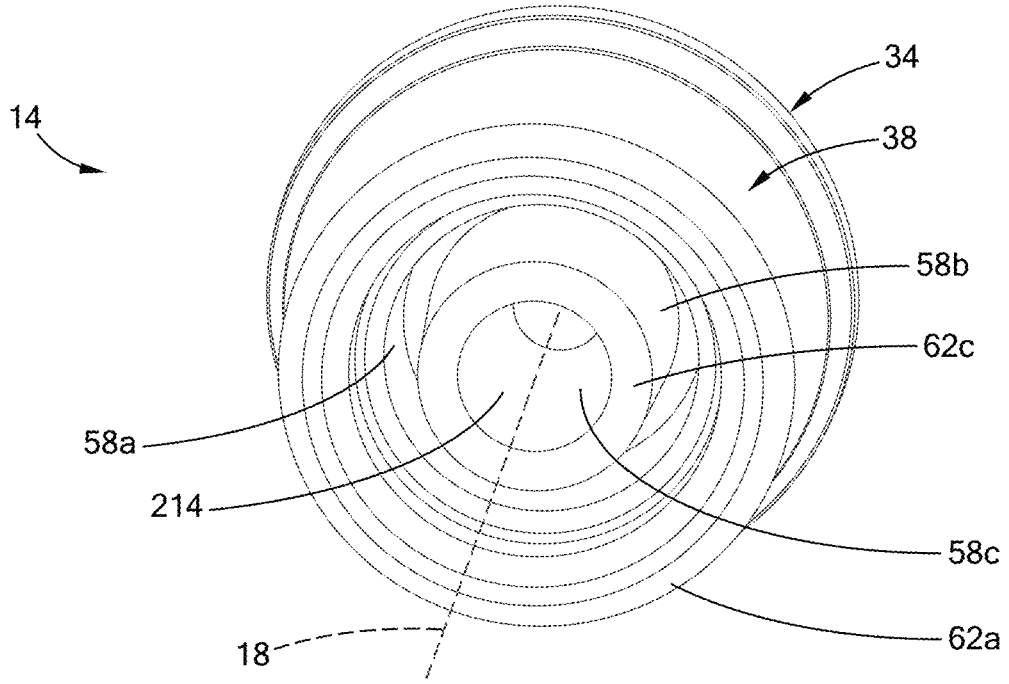
FIG. 11 is a bottom perspective view of the sleeve of FIG. 10.
Figure 12:
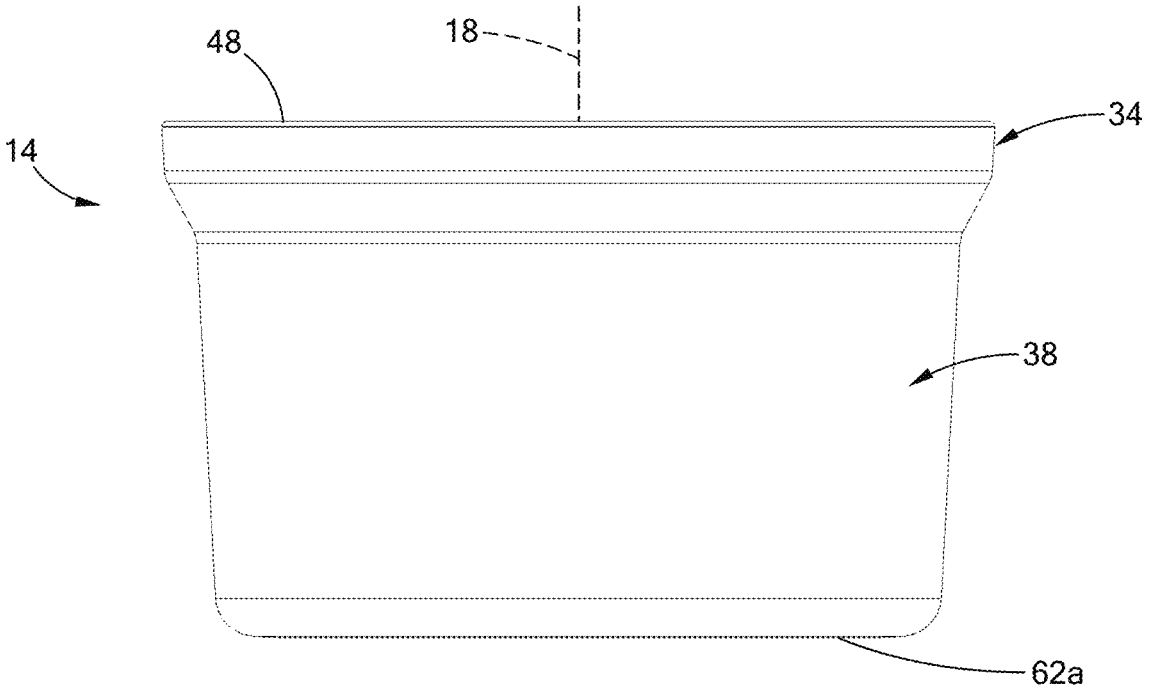
FIG. 12 is a side view of the sleeve of FIG. 10.
Figure 13:
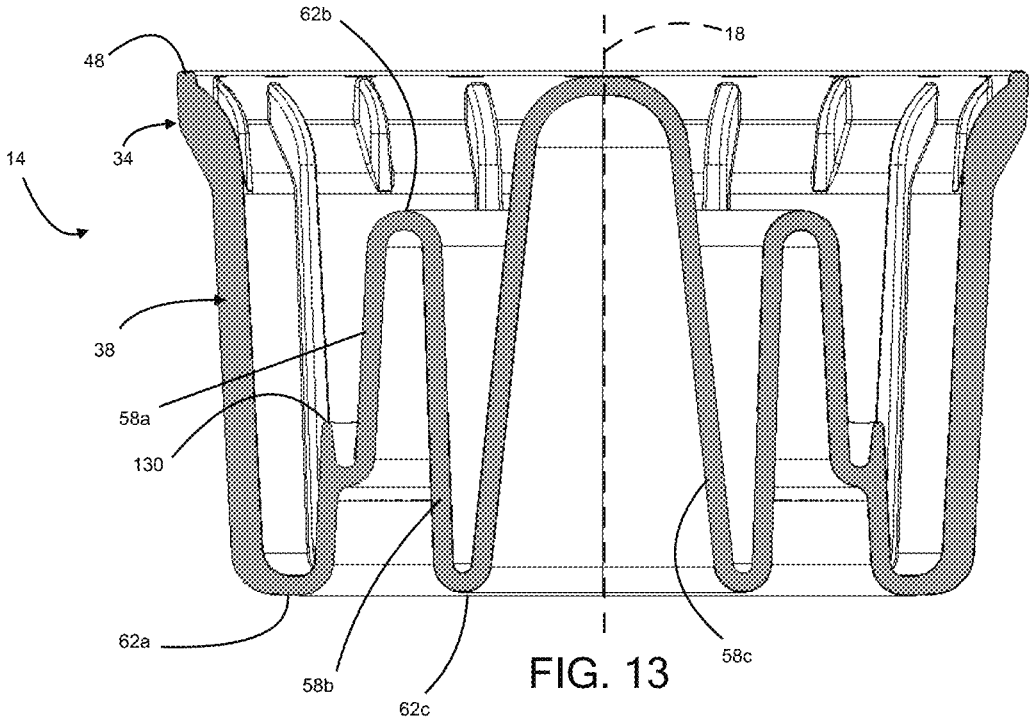
FIG. 13 is a cross-sectional view of the sleeve of FIG. 10.

With specific reference to FIGS. 8 and 9, the reservoir portion 42 defines a reservoir cavity 82 that narrows with each successive region 58*a*, 58*b*, 58*c*. The reservoir cavity 82 is open toward the grip portion 38 such that when the filter 54 is in contact with the spacer ribs 66, oil can flow between the filter 54 and the surface 70 of the grip portion 38 and into the reservoir cavity 82. In the example provided, the reservoir cavity 82 is closed at the bottom end 50 to retain oil therein, though other configurations can be used.

Referring to FIGS. 6-9, the support body 30 of the retainer 22 includes an outer ring 110, a plurality of spokes 114, and a hub 118. The outer ring 110 is mounted to the sleeve 14 and the spokes 114 extend radially between the outer ring 110 and the hub 118 to support the hub 118 within the sleeve 14. In the example provided, the support body 30 includes five spokes 114, though more or fewer spokes can be used. In an alternative configuration, not shown, a different type of supporting structure can extend between the outer ring 110 and the hub 118 to replace the spokes 114, such as a disc with drain holes, though other configurations can be used.

In the example provided, the outer ring 110 is supported within the first region 58*a* of the reservoir portion 42. In the example provided, a bottom rim 122 of the outer ring 110 is supported by the second step 62*b* and a top rim 126 of the outer ring 110 is retained by a retainer rib 130 of the sleeve 14. The retainer rib 130 extends radially inward from a wall 132 of the first region 58*a* and then axially downward toward the bottom end 50. The retainer rib 130 extends about the inner circumference of the sleeve 14 to cooperate with the wall 132 to define an annular retention cavity 134 disposed about the central axis 18. Thus, the top rim 126 of the outer ring 110 is received in this retention cavity 134.

With the support body 30 mounted to the sleeve 14, the hub 118 is coaxial with the central axis 18 and supports the magnet 26 within the sleeve 14. The hub 118 extends axially toward the grip portion 38 such that the magnet 26 is positioned in contact with or near to the end of the filter 54 when the filter 54 is positioned in the grip portion 38. Thus, the filter 54 can be attracted to the magnet 26 to retain the filter 54 within the sleeve 14 and retain the sleeve 14 on the filter 54.

In the example provided, the hub 118 is a generally tubular shape defining a central bore 138 within which the magnet 26 is located proximate to a top end 142 of the hub 118. In the example provided, the top end 142 of the hub 118 inhibits the magnet 26 from exiting the central bore 138 of the hub 118. The magnet 26 can be further retained or alternatively retained in the hub 118 by any suitable manner, such as an adhesive (not shown), press-fit, threads (not shown), overmolding by the hub 118, and/or fasteners (not shown) for example. In the example provided, the support body 30 is a rigid, unitarily molded body, though other configurations can be used. In the example provided, the support body 30 is a plastic material, though other materials can be used. In an alternative configuration, the support body 30 or portions thereof (e.g., the hub 118) can be a ferromagnetic material such that the magnet 26 can magnetize the support body 30 or those ferromagnetic portions thereof.

While shown as having a cylindrical shape, the magnet 26 may have any suitable size and shape. Similarly, the hub 118 can have any suitable shape configured to support the magnet 26. In the example provided, the bottom end of the central bore 138 is open. In an alternative configuration, not specifically shown, the bottom end of the central bore 138 may be closed or plugged such as with an epoxy for example. In the example provided, the top end 142 of the hub 118 extends radially inward of the central bore 138 but does not cover the entire central bore such that the magnet 26 may be visible within the central bore 138. In an alternative configuration, not specifically shown, the top end 142 of the hub 118 may completely close the central bore 138 to inhibit oil from entering the central bore 138 and contacting the magnet.

In an alternative configuration, not shown, the magnet 26 may be replaced with a suction cup supported by the hub and configured to engage the end of the filter 54.

Referring to FIGS. 8 and 9, the sleeve 14 is slid onto the filter 54 until the filter 54 contacts the retainer 22 or as far as the sleeve is able to otherwise slide for larger filters (not shown). If the filter 54 has a diameter that is less than the minimum diameter defined by the spacer ribs 66, then the sleeve 14 can still be maintained on the filter 54 by the magnet 26, freeing the user to adjust his/her grip or attend to different tasks. If the filter is larger than the minimum diameter defined by the spacer ribs 66, then the sleeve 14 will stretch around the filter 54 while maintaining a gap between the filter 54 and the surface 70 of the sleeve 14. Thus, the sleeve 14 can still be maintained on the filter 54 by the hoop stresses in the sleeve 14 due to the sleeve 14 stretching around the filter 54. Furthermore, the flexibility of the material permits the lip portion 34 and/or part of the grip portion 38 to be rolled or folded outward over on itself to permit use on shorter filters (not shown).

Additionally, the oil filter removal device 10 can be held below the oil pan (not shown) of the engine (not shown) while the oil plug (not shown) is removed. The magnet 26 will catch and retain the oil plug (not shown). If the bottom end 50 has a drain aperture (not shown), then the oil filter removal device 10 can act as a funnel while maintaining the oil plug (not shown) out of the oil catch basin (not shown).

Referring to FIGS. 10-13, the sleeve 14 can be flexibly moved from the extended position (shown in FIGS. 1-9) to a nested position (shown in FIGS. 10-13) after the retainer 22 is removed or before the retainer 22 is inserted. In the nested position, the grip portion 38 is disposed about the reservoir portion 42 with the third region 58*c* inverted into the second region 58*b*, and the first region 58*a* inverted into the grip portion 38.

The sleeve 14 can also be originally formed (e.g., molded) in the nested position. In the example provided, the tapered and stepped geometry along with the flexibility of the material of the sleeve 14 allows the sleeve 14 to be manufactured in the nested position. Manufacturing the sleeve 14 in the nested position can be done with relatively smaller and less complicated molds for less expense than would be required if molding the sleeve in the extended position. Furthermore, the sleeve can be shipped and/or stored when not in use in this nested position. Additionally, the nested position may permit easier cleaning of the sleeve 14 and also provides a flat bottom for resting on a shelf when not in use.

The nested position also permits additional uses of the sleeve 14. For example, in the nested position, the third region 58*c* now forms a protrusion 210 when viewed from the top and a cavity 214 when viewed from the bottom. A user may insert his/her hand through the top of the sleeve 14 to grip the inverted third region 58*c*. A tool (not shown) or the oil plug (not shown) may be positioned within the cavity 214 and the user may use the third region 58*c* to operate the tool (not shown) or unscrew the oil plug (not shown). The sleeve 14 can inhibit oil from dripping onto the user's hand. Furthermore, the cavity 214 can be used to catch and retain the oil plug (not shown).

Figure 14:
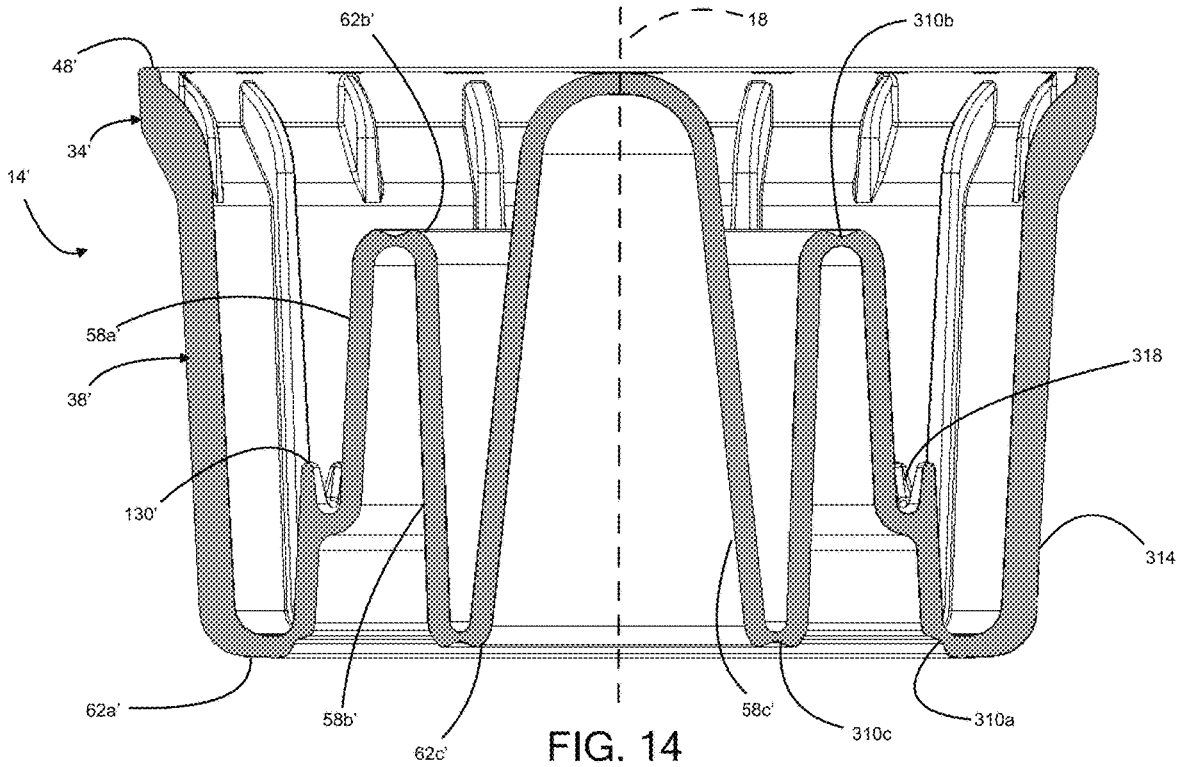
FIG. 14 is a cross-sectional view similar to FIG. 13, illustrating a sleeve of a second configuration in a nested position in accordance with the teachings of the present disclosure.
Figure 15:
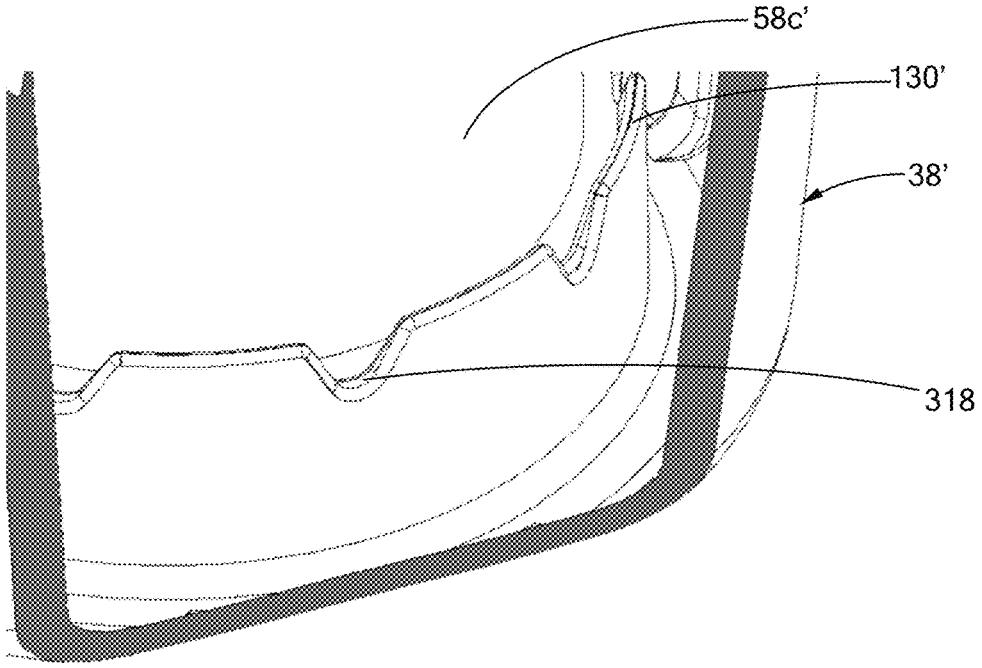
FIG. 15 is a cut-away perspective view of a portion of the sleeve of FIG. 14.
Figure 16:
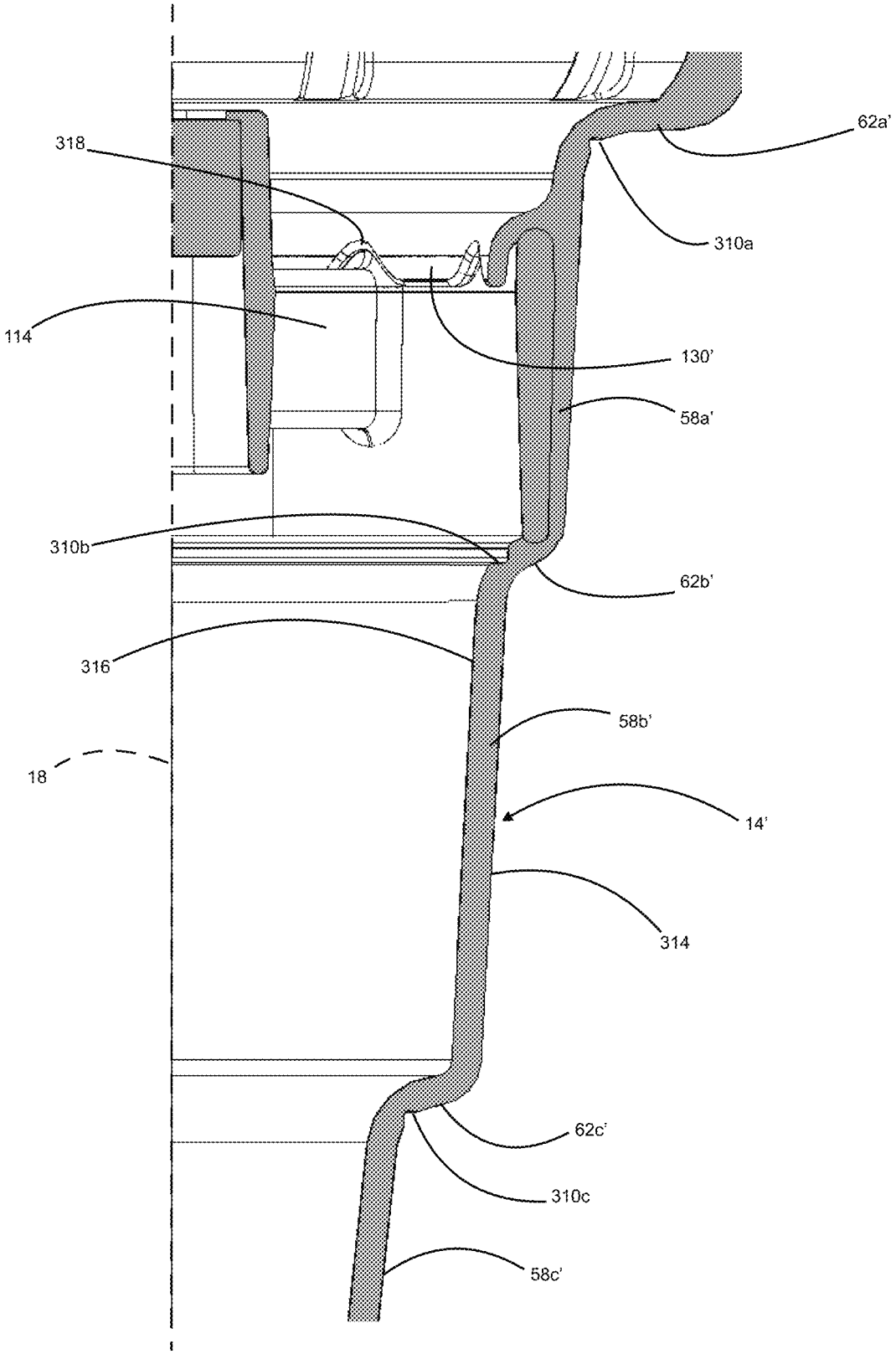
FIG. 16 is a cross-sectional view of an oil filter removal device including the sleeve of FIG. 14 in an extended position in accordance with the teachings of the present disclosure.

Referring to FIGS. 14-16, a sleeve 14' of a second configuration is illustrated. The sleeve 14' is similar to the sleeve 14 (FIGS. 1-13), except as otherwise shown or described herein. Features of sleeve 14' that are identified with primed reference numerals are similar to those with non-primed reference numerals except as otherwise shown or described herein. Accordingly, only differences are described herein.

The sleeve 14' may include stress grooves 310*a*, 310*b*, 310*c* located at the transitions from the steps 62*a*, 62*b*, 62*c* to the corresponding regions 58*a*, 58*b*, 58*c*. The groove 310*a* extends about a circumference of the sleeve 14 and, when the sleeve 14 is in the extended position, forms a recess in an outer surface 314 of the sleeve 14 located within the radius that forms the transition from the first step 62*a* to the first region 58*a*. The groove 310*b* extends about a circumference of the sleeve 14 and forms a recess in an inner surface 316 of the sleeve 14 within the radius that forms the transition from the second step 62*b* to the second region 58*b*. The groove 310*c* extends about a circumference of the sleeve 14 and forms a recess in the outer surface 314 of the sleeve 14 within the radius that forms the transition from the third step 62*c* to the third region 58*c*. These grooves can reduce deformation of the sleeve 14 when in the extended position.

The sleeve 14' also may include relief notches 318 defined in the retainer rib 130'. The relief notches 318 are spaced circumferentially apart about the retainer rib 130' and extend axially into the retainer rib 130'. The relief notches 318 may be spaced at intervals that correlate to the positions of the spokes 114 such that the spokes 114 can extend through the relief notches 318, as shown in FIG. 16. The relief notches 318 can also reduce compression stress when the sleeve 14' is in the nested position and the retainer rib 130' is inverted, as shown in FIGS. 14 and 15.

While described herein for use with oil and oil filters, the oil filter removal device 10 may be used in other applications and to catch other fluids.

As used herein, the phrase at least one of A, B, and C should be construed to mean a logical (A OR B OR C), using a non-exclusive logical OR, and should not be construed to mean "at least one of A, at least one of B, and at least one of C.

Unless otherwise expressly indicated, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, manufacturing technology, and testing capability.

The terminology used herein is for the purpose of describing particular example forms only and is not intended to be limiting. The singular forms "a," "an," and "the" may be intended to include the plural forms as well, unless the context clearly indicates otherwise. The terms "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

The description of the disclosure is merely exemplary in nature and, thus, examples that do not depart from the substance of the disclosure are intended to be within the scope of the disclosure. Such examples are not to be regarded as a departure from the spirit and scope of the disclosure. The broad teachings of the disclosure can be implemented in a variety of forms. Therefore, while this disclosure includes particular examples, the true scope of the disclosure should not be so limited since other modifications will become apparent upon a study of the drawings, the specification, and the following claims.

What is claimed is:

1. A device for removing an oil filter, the device comprising:

a sleeve including a grip portion and a reservoir portion, the grip portion including a wall and a plurality of spacer ribs, the wall being disposed about an axis and defining a filter cavity open through a first end of the grip portion to receive the oil filter therein, the spacer ribs extending radially inward from the wall and configured to engage the filter, the reservoir portion extending from a second end of the grip portion and defining a reservoir cavity open to the filter cavity, wherein the sleeve is movable between an extended position in which the reservoir portion is below the grip portion and a nested position in which the reservoir portion is at least partially nested within the grip portion; and a retainer disposed within the sleeve and configured to resist removal of the filter from the grip portion, wherein the retainer includes a support body and a magnet, the support body supporting the magnet within the sleeve, wherein the support body includes an outer ring, a hub, and a support structure extending radially between the outer ring and the hub to support the hub.

2. The device according to claim 1 wherein the spacer ribs are angled such that a radial distance between the axis and the spacer ribs increases toward the first end of the grip portion.

3. The device according to claim 2 wherein the wall is angled such that a radial distance between the axis and the wall increases toward the first end of the grip portion.

4. The device according to claim 1 wherein the grip portion transitions to the reservoir portion at a first step and the spacer ribs extend into the first step to space the filter apart from the first step.

5. The device according to claim 1 wherein the support structure includes a plurality of spokes.

6. The device according to claim 1 wherein the sleeve includes a retainer rib that inhibits axial movement of the outer ring.

7. The device according to claim 6 wherein the retainer rib extends circumferentially about the axis and defines a plurality of notches.

8. The device according to claim 1 wherein the sleeve includes a lip portion extending from the first end of the grip portion and angling radially outward therefrom.

9. The device according to claim 8 wherein the sleeve includes a plurality of lip support ribs extending radially inward from a wall of the lip portion.

10. The device according to claim 1 wherein the reservoir portion includes a first region and a second region, the first region transitioning into the grip portion at a first step and transitioning into the second region at a second step.

11. The device according to claim 10 wherein the reservoir portion includes a third region, the second region transitioning into the third region at a third step.

12. The device according to claim 10 wherein at least one of the first step and the second step includes a groove that extends circumferentially about the axis.

13. The device according to claim 1 wherein an end of the reservoir portion that is opposite the grip portion is closed to retain oil within the reservoir portion.

14. The device according to claim 1 wherein an end of the reservoir portion that is opposite the grip portion is open to permit oil to drain from the reservoir portion.

15. The device according to claim 1 wherein the entire sleeve is formed of a flexible material.

16. The device according to claim 1, wherein the magnet is disposed within the hub.

17. A device for removing an oil filter, the device comprising:

a flexible sleeve including a grip portion and a reservoir portion, the grip portion including a wall and a plurality of spacer ribs, the wall being disposed about an axis and defining a filter cavity open through a first end of the grip portion to receive the oil filter therein, the spacer ribs extending radially inward from the wall and configured to engage the filter, the reservoir portion extending from a second end of the grip portion and narrowing toward an end of the sleeve that is opposite the grip portion; and a retainer disposed within the sleeve, the retainer including a support body and a magnet, the support body being coupled to the sleeve and supporting the magnet within the sleeve, the support body including a hub and a support structure extending radially between the hub and the sleeve to support the hub within the sleeve.

18. The device according to claim 17, wherein the magnet is disposed within the hub.

19. A device for removing an oil filter, the device comprising:

a sleeve including a grip portion and a reservoir portion, the grip portion including a wall and a plurality of spacer ribs, the wall being disposed about an axis and defining a filter cavity open through a first end of the grip portion to receive the oil filter therein, the spacer ribs extending radially inward from the wall and configured to engage the filter, the reservoir portion extending from a second end of the grip portion and defining a reservoir cavity open to the filter cavity; and a retainer disposed within the sleeve and configured to resist removal of the filter from the grip portion, wherein the retainer includes a support body and a magnet, the support body supporting the magnet within the sleeve, wherein the support body includes an outer ring, a hub, and a support structure extending radially between the outer ring and the hub to support the hub.

* * * * *